United States Patent [19]

Vana

[11] 4,285,204

[45] Aug. 25, 1981

[54] DEFROSTING PROBLEM AREAS OF REFRIGERATED DISPLAY CASES

[75] Inventor: John H. Vana, Allentown, N.J.

[73] Assignee: Emhart Industries, Inc., Farmington, Conn.

[21] Appl. No.: 125,712

[22] Filed: Feb. 28, 1980

[51] Int. Cl.[3] ..... F25B 41/00; A47F 3/04; F25B 47/00

[52] U.S. Cl. ..... 62/81; 62/256; 62/278; 62/282

[58] Field of Search ..... 62/82, 151, 140, 160, 62/282, 255, 256, 324, 325, 81, 278

[56] References Cited

U.S. PATENT DOCUMENTS

| | | | |
|---|---|---|---|
| 2,929,227 | 3/1960 | Rainwater | 62/256 |
| 2,939,295 | 6/1960 | Robson | 62/140 |
| 3,082,612 | 3/1963 | Beckwith | 62/256 |
| 3,383,877 | 5/1968 | Liebermann et al. | 62/160 X |
| 3,937,033 | 2/1976 | Beckwith et al. | 62/282 X |
| 4,026,121 | 5/1977 | Aokage et al. | 62/151 |
| 4,120,174 | 10/1978 | Johnston | 62/256 |
| 4,144,720 | 3/1979 | Subera et al. | 62/282 X |
| 4,145,893 | 3/1979 | Vogel | 62/151 |
| 4,182,130 | 1/1980 | Ljung | 62/256 |

FOREIGN PATENT DOCUMENTS

| | | | |
|---|---|---|---|
| 2123646 | 11/1972 | Fed. Rep. of Germany . | |
| 2804008 | 8/1978 | Fed. Rep. of Germany | 62/256 |

*Primary Examiner*—Lloyd L. King

*Attorney, Agent, or Firm*—Frederick A. Zoda; John J. Kane; Albert Sperry

[57] ABSTRACT

Defrost of a refrigerated display case, especially those cases in which refrigerated air curtains are directed across open front or open top areas, is improved by reversing the direction of the air circulating fans during a predetermined portion of the time during which the case is in a hot gas defrost mode. In a preferred example, the evaporator fan motors are reversed following the initiation of a hot gas defrost cycle, at a time during the cycle when air warmed by the defrosting evaporator coil becomes available. A thermally actuated switch means effects the reversal at the appropriate time, so that areas of the refrigerated display case that would normally be the last to receive the benefits of the warmed air, in particular the return air flue and tank drain, become the first to be subjected to the warming effect thereof.

16 Claims, 6 Drawing Figures

DEFROSTING PROBLEM AREAS OF REFRIGERATED DISPLAY CASES

BACKGROUND OF THE INVENTION

1. Field of the Invention

The invention relates generally to refrigerated display cases, and in particular to the defrosting of such cases by combining hot gas defrost, which is to say utilization of the working fluid of the refrigeration system as a basic warming means, with the circulation of air to which heat has been transferred from the working fluid, over problem areas characterized by their high resistance to defrost.

2. Description of the Prior Art

Heretofore, in refrigerated display cases utilizing hot gas for defrost purposes, the practice has been to operate the conventional air circulating evaporator fans, during a defrost cycle. When the fans are operated during defrost, conventionally they circulate air through the duct or air passage of the case in the same direction as during the refrigeration mode. These areas, in particular the tank drain, are located conventionally on the return air side of the evaporator coil, so as to keep the drain at the highest possible temperature during a refrigeration cycle. So locating it, however, has an effect opposite from that desired, during a defrost cycle, because air conventionally circulated by the fans and warmed by the defrosting evaporator coil gives up a substantial part of its heat during its circulation through the same path and in the same direction as it travels during the refrigeration mode. The return air flue and the tank drain thus, during a defrost cycle, become the last to receive the warming effect of the circulated air in these circumstances.

Accordingly, it has been conventional practice to install additional tubing on many cases, the design of which renders the return air flue and tank drain areas thereof particularly difficult to defrost. This tubing is in effect a continuation of the tubing or piping through which the refrigerant fluid (and hence the hot gas) flows. The tubing is conventionally extended as a "warming loop" around the exterior of the evaporator coil and within the vicinity of the tank drain area. Thus, hot gas which would normally flow directly into the evaporator coil during the defrost cycle, is caused to first travel through the loop and over or around the tank drain, for transfer of heat directly from the loop to the coil and drain. The drain is thus defrosted by said heat transfer from the hot gas. The hot gas thereafter passes directly into the evaporator coil to accomplish the desired defrost thereof in a known manner.

The procedure of installing additional tubing, as warming loops, is a costly one. If not installed properly, it can result in icing in the tank and drain. Even so, the presence of a warming loop still has no effect on the return air flue, which being the last to receive the circulated air warmed by defrost of the coil, tends to be the slowest to reach a fully defrosted condition.

SUMMARY OF THE INVENTION

Summarized briefly, the invention is applicable to basically conventional refrigerated display cases, that is to say, open top or open front cases in which air is circulated in a closed path, and is refrigerated by heat transfer to an evaporator coil through which a working fluid is circulated during a refrigeration cycle.

In accordance with the invention, all components now utilized in a refrigeration system for a display case of the type utilizing hot gas for defrost purposes, are retained without change, so far as their physical construction, function, and relative location are concerned. In accordance with the invention, however, the conventional, uni-directional circulating fans are not used. Instead, reversible fans are employed, controlled by a thermally responsive switch means sensitive to the temperature of hot gas flowing through a defrosting evaporator coil. The switch means is set to reverse the fan motor at a predetermined time following the initiation of the defrost cycle, as for example, the switch means may be caused to close and reverse the direction of air movement when the temperature of gas flowing through the coil at the sensed location reaches 42° F. In a typical embodiment, the direction of air flow is reversed at this time by operation of the switch means, and the reverse air flow continues so that the first areas within the case that are impinged upon by air to which heat is transferred from the hot gas passing through the evaporator coil, will be the tank drain and the return air flue. Operation of the fan in the reverse direction continues under controlled conditions, for a period of time effective to fully defrost the tank drain and the return air flue.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DESCRIPTION OF THE PREFERRED EMBODIMENT

Figure 1A:
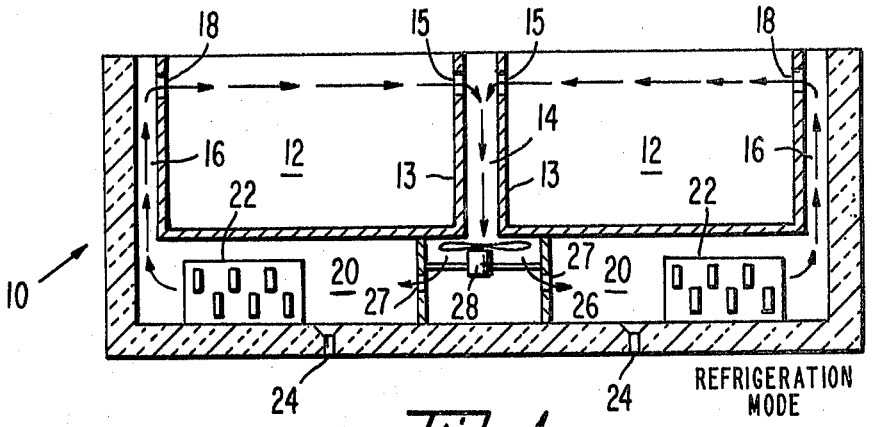
FIGS. 1*a* through 1*d* are cross-sectional views of a refrigerated display case of the so-called wide island single deck twin case type, showing the case at different phases or stages of operation during use of the invention.

In FIGS. 1*a* through 1*d*, there has been illustrated, in cross-section, a typical wide island refrigerated display case of the type in which, in effect, back-to-back individual cases are constructed in a unitized assembly. In an assembly of this type, a return air flue extending longitudinally and centrally of the assembly, and an air circulating means, is common to both cases, in a typical construction already in use in the industry for many years. A typical example of a case of this type is found in the patent to Rainwater, U.S. Pat. No. 2,929,227, the disclosure of which is incorporated herein by reference.

The display case 10 includes longitudinally extending product display areas 12, 12 the inner longitudinal sidewalls 13 of which define between them a longitudinally, centrally extending, vertically disposed air return flue or duct 14 having at its upper end air inlets 15. Formed in the outer longitudinal sidewalls of the respective display areas 12 are air discharge ducts 16 having at their upper ends air outlets or nozzles 18 disposed opposite their associated air inlets 15 of the flue 14.

Below the areas 12 are plenums 20 in which are mounted the evaporator coils 22 adjacent which are longitudinally extending drain troughs 24.

A fan housing 26 extending the length of the case and containing a plurality of air circulating fans 28 spaced along its length, opens upwardly into the air return flue 14, and communicates at its opposite sides with the respective plenums 20, through the provision of openings 27.

All this is conventional, and illustrates in a somewhat simplified and schematic fashion components and structure which have been fully detailed in the above mentioned Rainwater patent. With the exception that the air circulating fans 28 are of the fully reversible type in accordance with the present invention, the construction so far illustrated and described is essentially similar to that which has been disclosed in full detail in the Rainwater patent.

Figure 3:
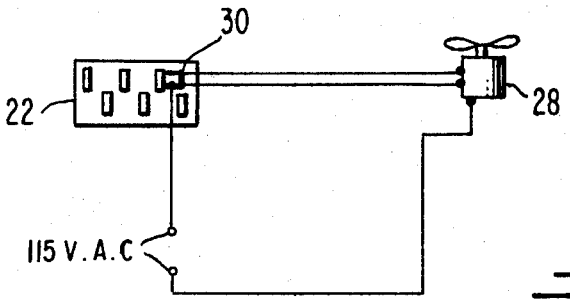
FIG. 3 is a highly simplified schematic representation of the electrical circuitry used in the invention.

The fans 28 are made reversible in the illustrated embodiment of the invention, and are in circuit with a source of electric power, as shown in FIG. 3, and also with a bi-metallic switch device 30 which in and of itself is wholly conventional. In actual tests, it has been found that the device manufactured by Therm-O-Disc, Inc., 1320 South Main St., Mansfield, Ohio 44907 as part number 37T33-43514-4Z is entirely suitable. A typical island case might be perhaps 10 to 12 feet in length, and it would be desirable to mount the switch where it will have the maximum sensitivity to changes in temperature occurring within the coil during a changeover from a refrigerating to a defrost mode and vice versa. In actual tests, for example, utilizing a two inlet coil, it was found that the switch means could be effectively mounted and used at a sensing location perhaps 12 feet from one of the inlets. It may be desirable, however, and it is indeed contemplated as being within the inventive concept, to locate the bi-metallic switch elsewhere, as for example, at the inlet itself.

At this point, it is worthy of note that the terms "inlet" and "outlet" or "discharge" or "return" are used in the sense of the function that these components would discharge during the refrigeration mode of the equipment. In a hot gas defrost installation, as is well known, the inlet to an evaporator coil becomes the outlet for the hot gas, while the coil outlet becomes the inlet, since hot gas defrost involves a reversal of the direction in which the fluid flows within the evaporator coil tubing.

It is of course true that other switch means may be mounted as controls for the fan or fans 28 as part of the conventional installation procedure. These have not been illustrated, since they are well known, and in any event should not be shown since they do not necessarily cooperate with the disclosed structure.

The switch 30, in the illustrated, disclosed embodiment, would be set to reverse the direction of the fans when the temperature of the coil tubing at the sensed location is elevated to a predetermined value, following the initiation of a defrost cycle. The switch under these circumstances would immediately reverse the fans to correspondingly reverse the direction of air flow. Thereafter, at such time as the fans are to revert to their normal direction in which they operate during the refrigeration mode, the bi-metallic switch is automatically reset following dropping of the temperature level at the sensed location to a different predetermined value.

OPERATION

FIGS. 1*a* through 1*d* illustrate the operation of the equipment at successively following phases of the operation. In FIG. 1*a*, thus, the case 10 is illustrated in the conventional refrigerating mode which characterizes the operation of the equipment during the major part of the time. In these circumstances, in the illustrated case the air flow is in the direction shown by the arrows in FIG. 1*a*, the evaporator coils being in a refrigerating mode to chill the air directed therethrough by operation of the fans in what may be considered as a normal, first direction, that is to say, the direction in which the fans circulate the air during normal refrigeration.

Particularly in a case of the type illustrated, it becomes important to assure a full and proper defrost of the air return flue 14 and that area of the tank bottom or plenum disposed between the fan housing and the evaporator coil 22, especially the tank drain 24. Cases of the type illustrated, though not alone in presenting problems with respect to defrosting of these particular areas, are particularly difficult to defrost fully except at considerable expense both in installation and in servicing requirements. This is by reason of the fact that the air return flue 14 is common to two separate and distinct air circulation paths, used for refrigerating separate, side-by-side product display areas 12. Frost build-up can be especially heavy in an air return flue under these circumstances. This characteristic of the common air return flue is made even more pronounced by the fact that the sidewalls 13 thereof are not insulated.

The problem of frost build-up in a return flue occurs, of course, in other types of cases, and it will be understood that the invention is not necessarily to be limited to the type of case disclosed. It is sufficient to note that in conventional refrigerated display cases of the type utilizing hot gas defrost of the evaporator coils, the air is circulated in a path such as shown in FIG. 1*a*, wherein the air, both during refrigeration and during the hot gas defrost cycle, continues to circulate in a direction from the evaporator, then to the air discharge duct 16, thereafter across the access opening into the product display area 12, and thereafter returning to the evaporator through the air return flue 14 and across the tank drain 24. The practice in the industry has been to locate the tank drain, and indeed the major portion of the floor of the plenum, on the return air side of the evaporator, so as to allow these areas to be at the highest possible temperature during refrigeration. However, during the defrost mode, the deliberate location of, for example, the tank drain on the return air side, becomes a liability, since these areas now become subjected to the lowest temperatures developed during the defrost cycle. The return air flue and the tank drain are thus subjected to the lowest temperatures in the case during a defrost cycle, when they should actually be at their peak or highest temperatures to assure defrost. The return air flue and the tank drain have thus become problem areas during the defrost mode, in cases in which hot gas defrost systems are utilized. To overcome the problem, it has been the practice to install warming loops of tubing within the case. These warming loops have conventionally been installed as portions of the suction line extending between the evaporator coil outlet and the compressors. The warming loop is not shown because the present invention renders it unnecessary. It is sufficient to note that it extends from the outlet of the evaporator coil, extends the full length coil. The reversal of the air direction, thus, has been found to have maximum benefits when continued through the remaining one-third and thereafter during the idle drain time during which there is no circulation of fluid within the coil.

The illustrated type of case is a particularly difficult application for hot gas defrost, but it has been found that when the hot gas defrost is combined with an air defrost in the manner described above, effective defrosting, during a normally timed defrost cycle, is readily achieved without the use of the expensive warming loops heretofore required. The air defrost, it may be noted, is not of the type that utilizes ambient air. Rather, considering that the coil is defrosted by hot gas, it may be noted that air passing through the coil in the reverse direction during phases C and D, is warmed by the transfer of heat from the coil to the air, so that the hot gas effectively becomes the heat producer for the circulating air, which then moves on under the force imparted thereto by the reversely operating fans, to defrost the tank drain and the air return flue.

In a low-bed, open-top case of the type illustrated and described herein, the discharge opening 18 is conventionally provided with a nozzle that directs the air flow across the area 12 in a path that is kept as straight as possible, when the fans are operating in their normal direction as in FIG. 1*a*. This path extends close to the chilled products and indeed, loses heat thereto when the case is in a defrost mode with the hot gas circulation and the fans operating in their normal direction shown in FIG. 1*a*. Heretofore, this has probably been a factor contributing to the inability to defrost the hereinbefore noted problem areas, since the loss of heat to the displayed products, as the air travels across the display area from the discharge opening 18 to the return air inlet 30, has reduced the ability of the air to defrost the problem areas of the case.

Figure 1B:
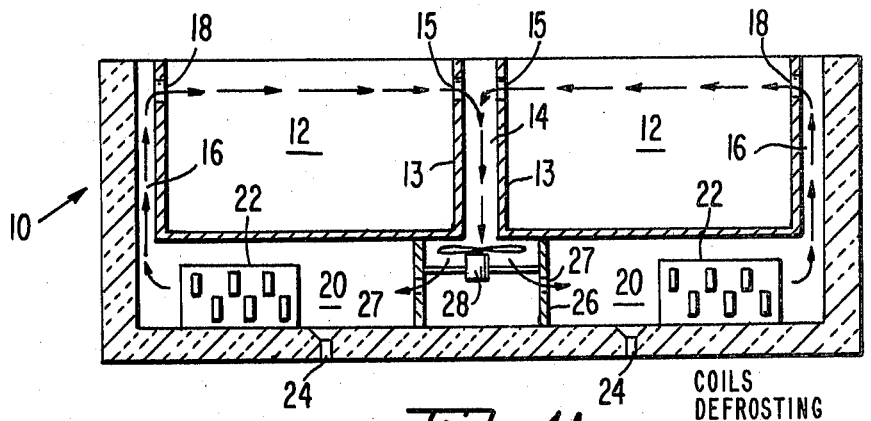
Figure 1C:
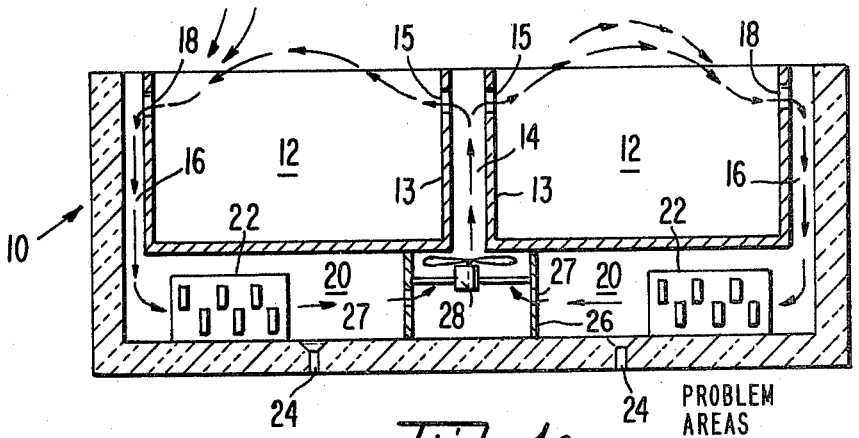
Figure 1D:
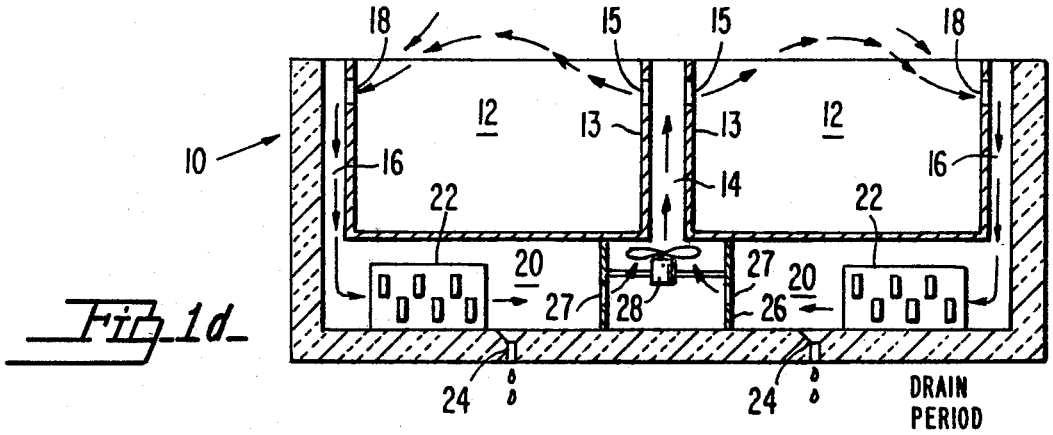

In the illustrated example, it has been found that when the air flow is reversed as in FIGS. 1*c* and 1*d*, the physical form of the return air inlet tends to direct the air in a path that bellies upwardly and that is then pulled downwardly into the discharge opening 18. This apparently results from the fact that the inlet 30 is not designed as a discharge nozzle. Hence, it does not cause the air flow to be maintained in a low, straight path, when the return inlet 30 assumes the function of a nozzle. It assumes this function when the fan is reversed, in phases C and D of each defrost cycle.

This has the desirable effect of minimizing chilling of the air by the displayed products, during phases C and D, since the air flow is well above the products. Instead, a highly beneficial effect is obtained. Ambient air is mingled or entrained with the air as it travels across the area 12. It thus tends, if anything, to elevate, not lower, the air temperature within this aspect of the closed air circulation pattern, distinctly contributing to the highly beneficial, more efficient combination of hot gas and air defrost discussed previously herein.

While particular embodiments of this invention have been shown in the drawings and described above, it will be apparent that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. In a refrigerated display case having a product display area, an air passage extending about the display area and formed with an air return flue, an air discharge duct, and a plenum providing communication between the flue and duct, an evaporator in the plenum adapted to be defrosted by hot gas flowing therethrough, at least one air circulating fan in the passage, the air circulated within the passage normally flowing, when the case is in a refrigeration mode in a first direction in which it flows through the evaporator in heat exchanging relation thereto, then through the discharge duct and thereafter back to the evaporator through the return air flue, the improvement that comprises a system of combining hot gas defrost of the evaporator coil with air defrost of at least the return air flue, said system including means for reversing the direction of air circulated within the passage at a time during the hot gas defrost cycle when the evaporator is transferring heat to air flowing therethrough, for defrosting of the air return flue by circulating therethrough, directly from the plenum, reversely flowing air that has been warmed by the transfer thereto of heat produced by hot gas defrost of the evaporator.

2. A combination hot gas and air defrost system for refrigerated display cases as in claim 1 wherein said means for reversing the direction of the circulated air is limited to operation at a time after initiation of the hot gas defrost of the evaporator.

3. A combination hot gas and air defrost system for refrigerated display cases as in claim 1 wherein said means for reversing the air direction becomes effective to change the direction of the circulated air from the first to an opposite direction subsequent to initiation of hot gas defrost of the evaporator, and is effective to maintain circulation of air in said opposite direction for at least the remainder of time during which the evaporator is undergoing hot gas defrost.

4. A combination hot gas and air defrost system as in claim 3 in which said means includes, in electrical circuit with at least one air circulating fan, electrical switch means thermally responsive to changes in temperature in the area of the evaporator, and mounted in circuit with at least one circulating fan to reverse the direction of air circulation from said first direction, upon temperature elevation to a predetermined value in said area.

5. A combination hot gas and air defrost system for refrigerated display cases as in claim 4 wherein said switch means responds to reduction in the temperature in said area to cause the circulation of air to revert to said first direction thereof.

6. A combination hot gas and air defrost system as in claim 5 wherein the temperature at which the switch means resets to cause the air circulation to revert to said first direction, occurs no earlier than initiation of the next following refrigeration mode.

7. In a refrigerated display case having a product display area, an air passage extending about the display area and formed with an air return flue, an air discharge duct, and a plenum providing communication between the flue and duct, an evaporator in the plenum adapted to be defrosted by hot gas flowing therethrough, and a drain disposed in the plenum between the evaporator and the air return flue, the air circulating within the passage normally flowing, when the case is in a refrigeration mode, in a first direction in which it flows through the evaporator in heat exchanging relation thereto, then through the discharge duct and thereafter back to the evaporator through the return air flue, the improveof the coil and back to comprise a complete loop around the coil, extending in close proximity to the tank drain for the full length of the drain, and is further extended within the center island area defined by the fan housing 26 and the air return flue 14, after which it continues on as the suction line to the compressor.

The purpose of such a loop is readily apparent. While the hot gas effectively defrosts the evaporator coil, it has been found that the tank drain is prone to freeze up and remain frozen, and indeed has a tendency to do so during the melting of frost from the evaporator coil itself, if the warming loop is not used. At the same time, frost tends to remain within the return air flue, since as previously noted the air is still being circulated in the same direction as it is during the refrigerating mode. Although the air is warmed by the defrosting evaporator coil, it travels through the air discharge duct, across the product area, and thereafter into the air return flue and across the tank drain, so that the flue and drain are the last to receive the benefits of the air. A considerable temperature drop will have occurred in the circulating air in these circumstances, and this has been the reason why the flue and tank drain are not defrosted and require special warming loops formed out of the suction line to provide direct heat transfer to the problem areas from the hot gas after it leaves the evaporator coil for flow back into the lines through which refrigerant is being directed to other evaporators that are in a refrigerating mode.

It has thus been necessary, in a case of the type illustrated, to provide warming loops with appropriate fittings and valving, utilizing as much as perhaps 115 feet of tubing in a 12 foot case. This is quite expensive, and in addition, may require considerable servicing expense during the life of the case.

Figure 2:
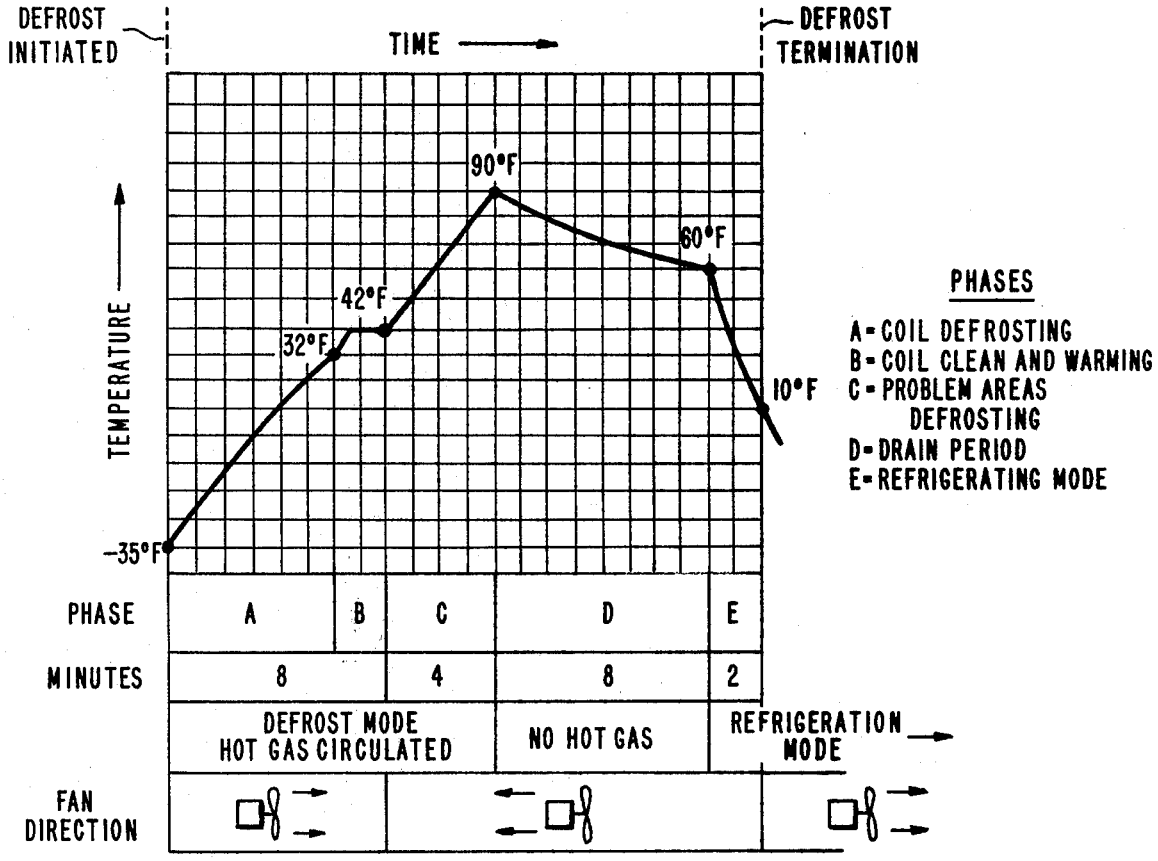
FIG. 2 is a graphic representation illustrating the operation of the invention.

As noted above, the warming loops are rendered unnecessary in accordance with the present invention. Conventional piping is utilized throughout, and the entire defrost operation, including a defrost of the evaporator coil, as well as the problem or critical areas noted, is achieved by a combination of hot gas defrost and air defrost, following steps as shown in FIG. 2. Referring to this figure of the drawing, let it be assumed that a defrost cycle has been initiated. At the beginning of the defrost cycle, and taking an ice cream case as a typical example, the temperature at the sensed location on the evaporator coil would be on the order of about −35° F. As the flow direction within the coil is reversed, for passage of hot gas through the coil from the suction line, the temperature at the sensed location is rapidly elevated till it reaches the 32° F. level. In the illustrated diagram or chart, this is phase A, during which the coil is defrosted. In a typical ice cream case installation, phase A takes about six minutes. During this time, the hot gas is continuously circulated through the coil, and the fan direction remains unchanged, that is, the fan is still operating in a direction to circulate the air as in FIG. 1*a*, this being the direction in which the air flows during normal refrigeration.

In accordance with the invention, phase B now begins, lasting for perhaps two or three minutes, this being a phase during which the coil is clean and is being further warmed. A further temperature elevation occurs, up to, for example, 42° F.

At this point, the bi-metallic switch 30 is set to reverse the direction of the air circulating fans 28.

This has been found desirable in that maximum effectiveness can be made of the use of the circulating air in combination with hot gas defrost, for the purpose of warming the above mentioned critical areas, if full concentration is first directed toward defrosting of the coil itself, after which a short time lapse should occur during which the coil is clean and is warming still further, preparatory to defrost of the critical areas. FIG. 1*b* shows the equipment still in the phase A portion of the defrost cycle. FIG. 1*c* shows the equipment at the beginning of phase C. Here, as shown by the FIG. 2 diagram, reversal of the fan operation has been effected responsive to a sensing of the predetermined temperature (in this case 42° F.) on the evaporator coil. As hot gas continues to circulate through phase C, air is now circulated from the evaporator over the tank drain, and into the center island including the return air flue. These are the critical areas, and thus receive the maximum benefit of warmed air, immediately after it leaves the evaporator. Melting of ice and frost from the tank drain and return air flue is thus effectively instituted, and continues throughout phases C and D. Phase C, taking about four minutes, gives way to phase D, during which no hot gas is circulated through the evaporator coil. At the same time, continued flow of air in the direction shown in FIG. 1*c* occurs, with the temperature steadily rising at the sensed location. A full defrost of the critical areas is thus achieved, in phases C and D, over a period of perhaps twelve minutes in all.

The defrost cycle is terminated conventionally. It is the usual practice to include a "fail-safe" timing switch, which terminates every defrost cycle after a predetermined time has passed from initiation of the cycle. In an ice cream case, thus, this total time may be set at 20 minutes. The conventional practice, however, may also be to allow earlier termination of the heating portion of the defrost, by operation of thermally responsive devices if a full defrosting of the equipment has been completed. Thus, phase D may vary considerably in many instances. The eight minute period illustrated by way of example might appropriately be considered as the maximum time during which there is drainoff with no flow of fluid through the evaporator. Throughout this time, the fan operation continues in the reverse direction shown in FIG. 1*c*.

At the conclusion of phase C, circulation of the hot gas ends, and the temperature at the sensed location may rise, in an ice cream case, to perhaps 90° F. The equipment now goes into phase D, during which no hot gas is being circulated, and drainoff occurs. During this phase, there may be a drop in temperature to about 60° F. in a typical ice cream case installation.

The equipment now goes into the refrigeration mode, phase E, with the air circulation still being in the direction shown in FIG. 1*c* for a period of perhaps two minutes after beginning of the refrigeration cycle. This results from the re-set requirements of a typical switch 30, and does not adversely affect the refrigeration mode in any way. At this time, the bi-metallic switch 30 is set to again reverse the fan direction at perhaps 10° F. When the temperature at the sensed coil location goes down to this level, the switch again reverses the fan, so that the air circulation reverts to the direction shown in FIG. 1*a*.

It is significant, in this regard, that the optimum situation, in an ice cream case used as the example in the illustrated diagram of FIG. 2, is to have the air circulation in the normal direction in which it circulates during refrigeration, for perhaps two-thirds during the time during which the hot gas is being circulated through the ment that comprises a system of combining hot gas defrost of the evaporator coil with air defrost of the return air flue and the drain, said system including means for reversing the direction of air circulated within the passage at a time during the hot gas defrost cycle when the evaporator is transferring heat to air flowing therethrough, for defrosting of the flue and the drain by impingement thereon, directly from the plenum, of reversely flowing air that has been warmed by the transfer thereto of heat produced by hot gas defrost of the evaporator.

8. A combination hot gas and air defrost system for refrigerated display cases as in claim 7 wherein said means includes a bi-metallic switch in electrical circuit with and controlling the operation of at least one air circulating fan, said bi-metallic switch being mounted upon the evaporator coil in position to sense the thermal response to the coil to the hot gas flowing therethrough, the switch being adapted to change the direction of air circulation from said first direction to an opposite direction upon elevation of the coil temperature at the sensed location to a value at least sufficient to initiate melting of frost from the coil.

9. A combination hot gas defrost and air defrost system for refrigerated display cases as in claim 8, in which said bi-metallic switch is adapted to reverse the direction of operation of at least one air circulating fan when the coil temperature at the sensed location measurably exceeds the temperature at which melting of the frost from the coil occurs.

10. A combination hot gas and air defrost system for refrigerated display cases as in claim 9 in which the bi-metallic switch maintains operation of the fan controlled thereby in said reverse direction for a period of time extending beyond termination of the circulation of hot gas through the evaporator.

11. A combination hot gas and air defrost system for refrigerated display cases as in claim 10, wherein the bi-metallic switch is arranged to prevent reversion of the controlled fan to operate in said first direction at a time prior to initiation of the next following refrigerating mode.

12. The method of defrosting a refrigerated display case that comprises the steps of circulating hot gas through an evaporator coil of said case while maintaining operation of an air circulating fan to circulate air through the coil in the direction in which the air is circulated during normal refrigeration modes of the case; thereafter reversing the direction of air circulation during the continued circulation of hot gas through the evaporator coil to defrost areas within the case normally upstream from the evaporator in the sense of the direction of air during the refrigerating mode; and thereafter again reversing the direction of air circulation to cause the same to revert to the direction in which air flows within the case during the refrigerating modes thereof.

13. The method of defrosting a refrigerated display case as in claim 12, further including maintenance of air circulation in the reverse direction from that used during normal refrigerating modes of the case, at least up to the initiation of the refrigerating mode next following the defrost cycle.

14. A method as in claim 13 wherein the maintenance of the air circulation in the reverse direction includes directing the air in a path extending outwardly of the case to commingle therewith ambient air from the vicinity of the case.

15. The method of defrosting a refrigerated display case as in claim 14, further including reversing the direction of air circulation from the direction in which it circulates during normal refrigerating modes, by sensing the temperature at a selected location upon the evaporator coil.

16. The method of defrosting a refrigerated display case of claim 15, further including delaying of the reversal of the direction of air circulation from that direction in which the air circulates during normal refrigerating modes, until the temperature at the sensing location is in excess of that at which defrosting of the coil occurs.

* * * * *

UNITED STATES PATENT AND TRADEMARK OFFICE

CERTIFICATE OF CORRECTION

PATENT NO. : 4,285,204
DATED : August 25, 1981
INVENTOR(S) : John H. Vana

It is certified that error appears in the above-identified patent and that said Letters Patent are hereby corrected as shown below:

Column 9, line 17, change "to" to --of--

Signed and Sealed this

*Twenty-third* Day of *February 1982*

[SEAL]

*Attest:*

GERALD J. MOSSINGHOFF

*Attesting Officer*

*Commissioner of Patents and Trademarks*